United States Patent [19]

Billet

[11] Patent Number: 4,921,143

[45] Date of Patent: May 1, 1990

[54] PORTABLE BEVERAGE DISPENSER

[75] Inventor: Robert L. Billet, Lower Gwynedd, Pa.

[73] Assignee: Thirst Aid, Inc., Gwynedd, Pa.

[21] Appl. No.: 262,546

[22] Filed: Oct. 25, 1988

[51] Int. Cl.[5] ..... B67D 5/64

[52] U.S. Cl. ..... 222/175; 222/383; 224/148

[58] Field of Search ..... 222/175, 383, 384, 397, 222/394; 224/148

[56] References Cited

U.S. PATENT DOCUMENTS

| | | | |
|---|---|---|---|
| 1,356,657 | 10/1920 | Phister | 222/175 |
| 1,673,007 | 6/1928 | Kaiser | 222/175 |
| 2,105,339 | 1/1938 | Sweitzer | 222/175 |
| 2,350,184 | 5/1944 | Oys | 224/148 |
| 2,558,181 | 6/1951 | Kassel | 222/175 |
| 2,684,787 | 7/1954 | Charpiat | 224/148 |
| 2,704,627 | 3/1955 | Brulin et al. | 222/175 |
| 2,732,977 | 10/1957 | Charpiat | 222/175 |
| 2,767,885 | 10/1956 | Miller | 222/175 |
| 2,808,965 | 9/1962 | Graphia, III et al. | 222/175 |
| 3,147,889 | 9/1964 | Dolgin | 222/175 |
| 3,262,609 | 7/1966 | Poitras | 222/175 |
| 3,286,884 | 11/1966 | Long, Jr. | 222/175 |
| 3,348,741 | 10/1967 | Wooten | 224/148 |

FOREIGN PATENT DOCUMENTS

| | | | |
|---|---|---|---|
| 212578 | 4/1954 | Australia | 222/175 |

*Primary Examiner*—Kevin P. Shaver
*Assistant Examiner*—Kenneth Noland
*Attorney, Agent, or Firm*—Caesar, Rivise, Bernstein, Cohen & Pokotilow, Ltd.

[57] ABSTRACT

A portable beverage dispenser adapted to be carried by a vendor includes an insulated tank having an internal compartment in which a beverage to be dispensed is retained. A discharge passage is provided through a wall of the insulated tank and communicates with the internal compartment adjacent a lower end of the compartment. A pressurizing passage extends through a wall of the tank and communicates with the internal compartment adjacent an upper end of the compartment. A pump is attached to the tank and includes a fluid transmitting line for directing a pressurizing gas into the upper end of the internal compartment through the pressurizing passage for pressurizing a beverage within the compartment, and a nozzle communicates with the discharge passage adjacent the lower end of the internal compartment for dispensing the beverage. In a preferred embodiment a cup dispenser also is attached to the insulated tank, and most preferably both the pump and the cup dispenser are attached to sidewall sections of the tank.

18 Claims, 4 Drawing Sheets

FIG. 2
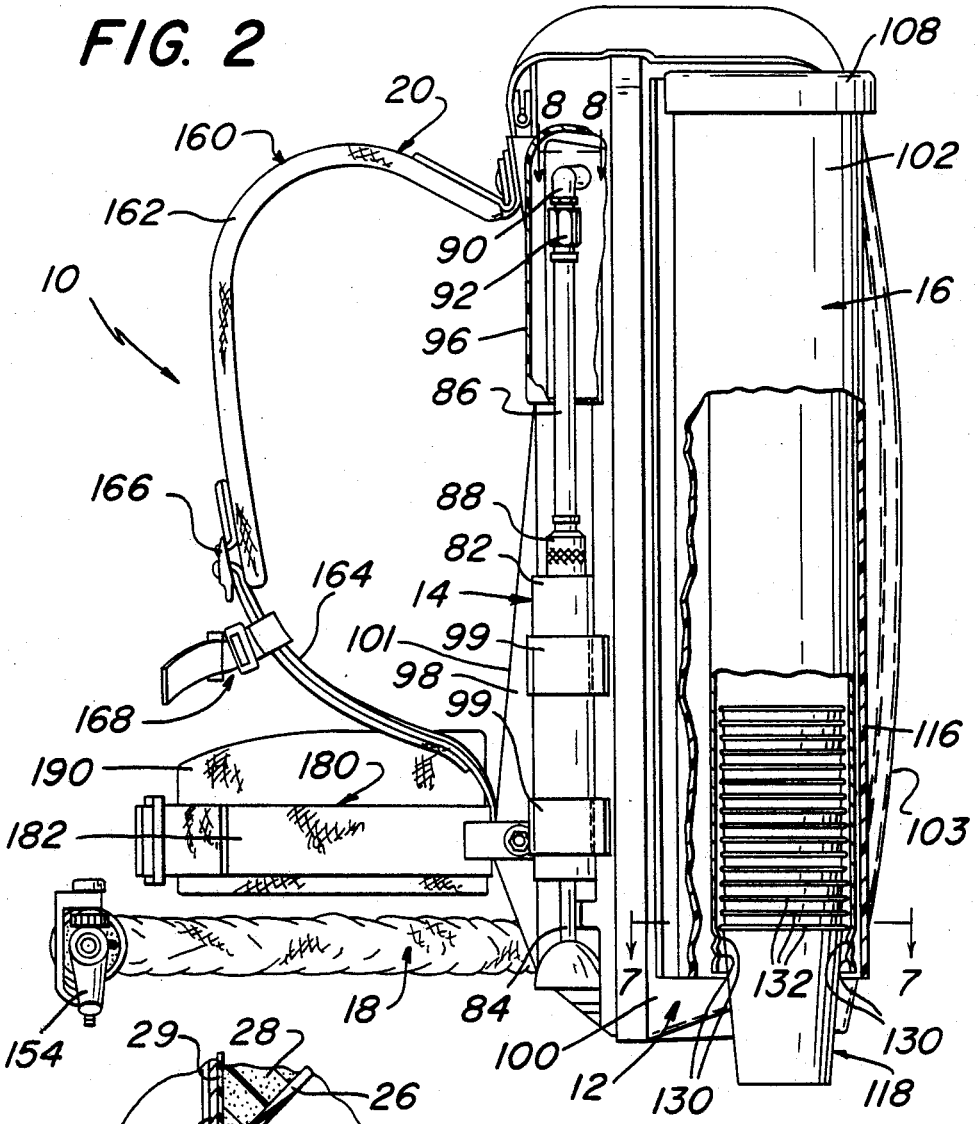
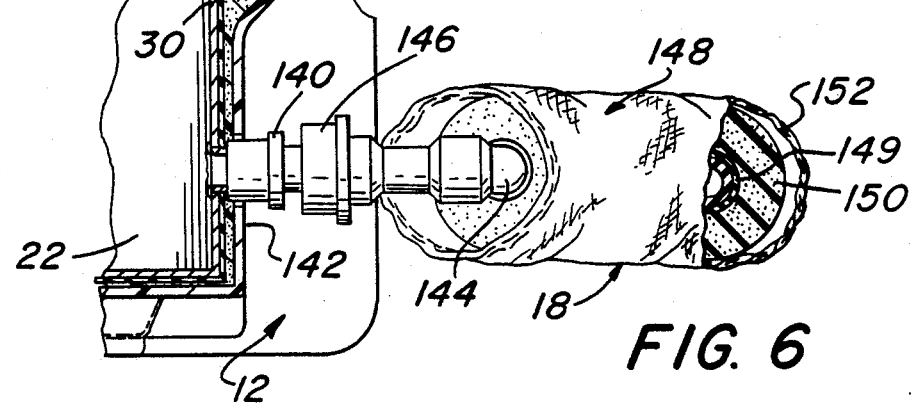
FIG. 6

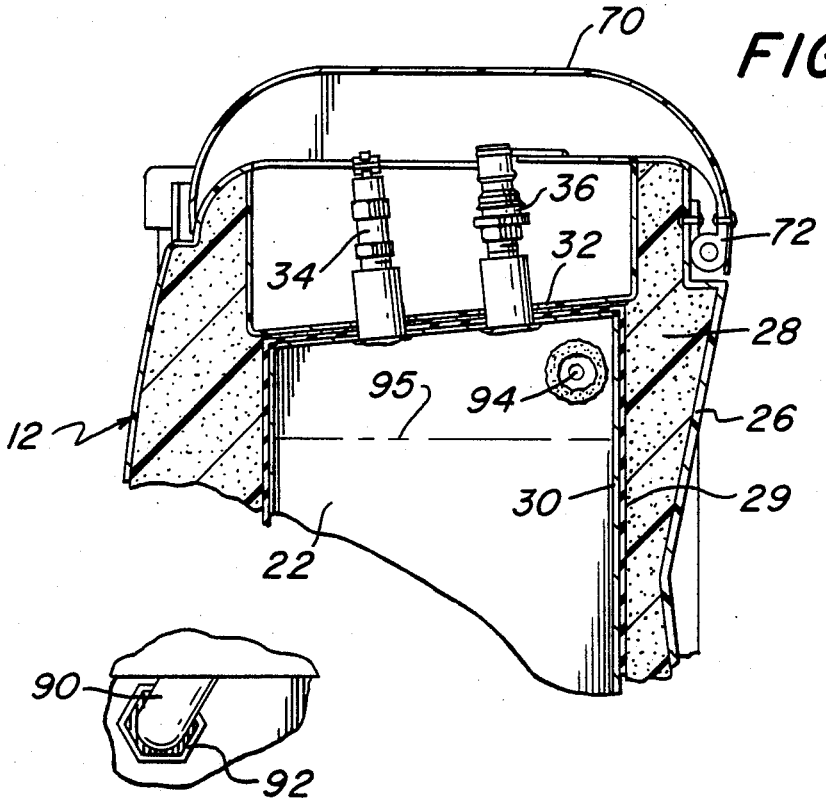
FIG. 4
FIG. 8
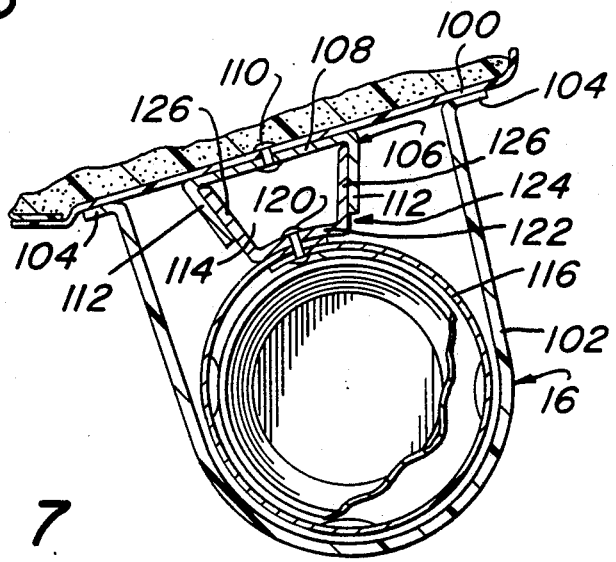
FIG. 7

PORTABLE BEVERAGE DISPENSER

FIELD OF THE INVENTION

This invention relates generally to portable beverage dispensers, and more specifically to portable beverage dispensers which easily can be carried by a vendor for dispensing hot and cold beverages.

BACKGROUND ART

It is quite common at athletic events and other events which draw large crowds for vendors selling or dispensing hot and cold beverages to circulate among the people. For example during sporting events, such as baseball and football games, it is common for vendors to carry containers of soda, beer, coffee, hot chocolate, etc. for sale to the fans. This has proven to be a cumbersome and relatively expensive means of distributing beverages.

There also have been numerous suggestions in the prior art of providing portable beverage dispensers having tanks from which a beverage to be dispensed is retained, and from which the beverage is directed, through a dispensing nozzle, and into a paper or plastic cup. Although applicant believes that the use of portable dispensers for dispensing beverages from a tank is the preferable way to dispense such beverages, the prior art systems do not appear to have met with any significant commercial success.

A number of prior art portable beverage dispensers also include a cup dispenser as part of their construction. Representative beverage dispensers of this type are disclosed in U.S. Pat. Nos. 1,673,007 (Kaiser); 2,105,339 (Sweitzer); 2,350,184 (Oys); 2,558,181 (Cassel); 2,704,627 (Brulin et al.) and 3,286,884 (Long, Jr.).

U.S. Pat. Nos. 3,147,889 (Dolgin) and 2,732,977 (Charpiat), in addition to some of the above-identified patents, disclose systems for introducing a pressurizing gas into the beverage to be dispensed. The Dolgin '889 patent discloses a beverage dispenser which employs a horizontally oriented hand pump to pressurize a beverage tank which is retained within an outer housing. In the Dolgin dispenser the beverage to be dispensed is directed through a discharge passage in the beverage tank, which is located in the same wall as the pressurizing passage through which pressurizing air is introduced.

Other prior art portable beverage dispensers are disclosed in U.S. Pat. Nos. 2,684,787 (Charpiat) and 2,808,965 (Graphia III, et al.).

It is applicant's belief that none of the above prior art systems have received commercial recognition because they either are too expensive to construct, or are not sufficiently versatile or reliable.

OBJECTS OF THE INVENTION

It is a general object of this invention to provide a portable beverage dispenser which is simple in construction and easy and reliable to use.

It is a more specific object of this invention to provide a portable beverage dispenser which easily can be pressurized, even in crowded quarters, to assist in the effective dispensing of a beverage.

It is a further object of this invention to provide a beverage dispenser which includes all of the necessary elements for dispensing a beverage associated therewith, including a cup dispenser and a pressurizing device.

It is further object of this invention to provide an efficient arrangement of elements in a portable beverage dispenser to make it easy for a vendor to dispense a beverage therefrom.

SUMMARY OF THE INVENTION

The above and other objects of this invention are achieved in a portable beverage dispenser having an insulated tank with an internal compartment for receiving a beverage to be dispensed, a discharge passage means provided through a wall of the insulated tank and communicated with the internal compartment adjacent a lower end thereof, a fillport communicating with the internal compartment for introducing a beverage therein, a pressurizing passage through a wall of the tank and communicating with the internal compartment adjacent an upper end thereof, pump means attached to the tank and including a fluid transmitting line communicating with the pressurizing passage for introducing a pressurizing gas into the upper end of the internal compartment of the tank and a nozzle means communicating with the discharge passage means for dispensing the beverage from the tank.

In a preferred embodiment of this invention a cup dispenser is secured to the wall of the tank for supporting a stack of cups to be utilized in serving the beverage to be dispensed.

In the most preferred embodiment of this invention the tank has an elongate dimension between upper and lower walls thereof, and the pump means, which preferably is a hand actuated pump, includes a gas accumulating chamber and a hand actuatable plunger for directing air into the chamber and then dispensing the air into the pressurizing passage of the insulated tank. Most preferably the hand pump is oriented so that reciprocating movement of the plunger, both into and out of the gas accumulating chamber, is in a direction substantially parallel to the elongate dimension of the tank.

In the most preferred form of this invention the insulated tank includes opposed sidewalls on which the pump means and cup dispenser are mounted. Most preferably each sidewall has a front sidewall section which slopes rearwardly from a front wall of the tank and a rear sidewall section which slopes forwardly from a rear wall of the tank, wherein the cup dispenser is attached to a rear sidewall section of the tank and the pump means is attached to a front sidewall section of the tank. This arrangement provides convenient access to both the cups and pump means for permitting effective use of the dispenser.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 2 is a side elevational view taken from the left side of FIG. 1 with parts broken away to show certain details of construction;

FIG. 4 is an enlarged fragmentary sectional view taken along line 4—4 of FIG. 1;

FIG. 6 is an enlarged fragmentary sectional view taken along line 6—6 of FIG. 1;

FIG. 7 is an enlarged sectional view taken along line 7—7 of FIG. 2; and

FIG. 8 is an enlarged sectional view taken along line 8—8 of FIG. 2.

DESCRIPTION OF THE BEST MODE OF THE INVENTION

Figure 1:
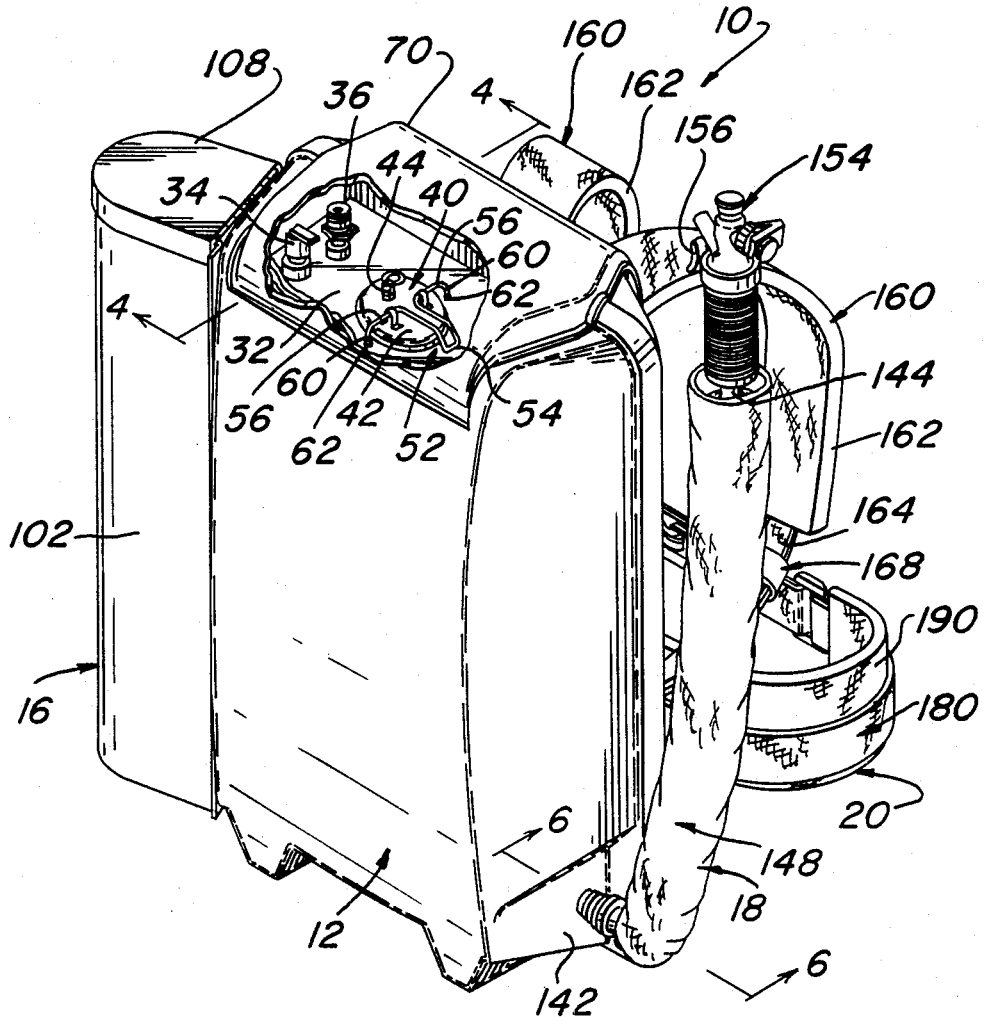
FIG. 1 is an isometric view of the portable beverage dispenser of this invention.

Referring now in greater detail to the various figures of the drawings wherein like reference characters refer to like parts, a portable beverage dispenser embodying the present invention is generally shown at 10 in FIGS. 1 and 2. The dispenser 10 basically comprises a beverage-containing, insulated tank 12, a hand actuated pump 14 for pressurizing the interior of the tank from the top thereof, a cup dispenser 16 for retaining a stack of paper or plastic cups to be dispensed one at a time, and a dispensing hose and nozzle assembly 18 for dispensing a beverage from the bottom of the tank 12. In addition a strap assembly 20 is provided for supporting the dispenser 10 on the back of a vendor.

Figure 5:
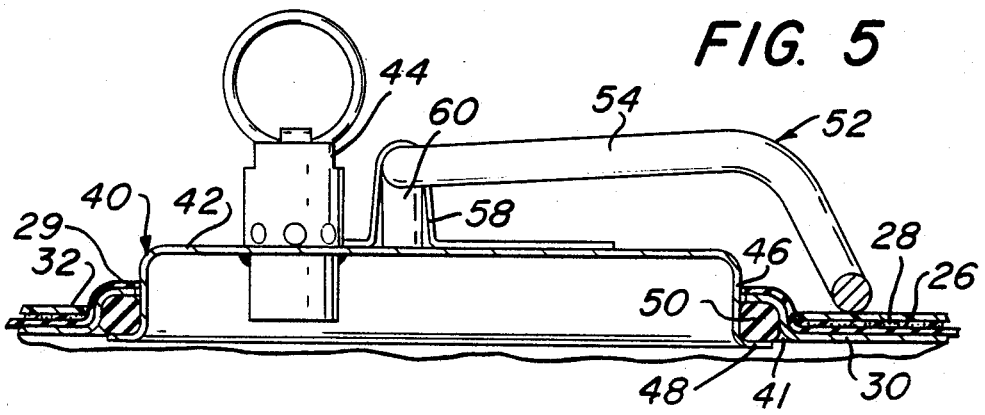
FIG. 5 is an enlarged fragmentary sectional view taken along line 5—5 of FIG. 3.

Referring specifically to FIGS. 4, 5 and 6, the insulated tank 12 includes an internal compartment 22 for retaining a beverage to be dispensed. The tank 12 includes a 4-ply, peripheral wall construction 24 including an outer plastic wall 26, a foam insulating central core 28, an inner stainless steel wall 30 and a neoprene rubber jacket 29 surrounding all surfaces of the stainless steel wall. It should be understood that stainless steel is employed in the inner wall construction for sanitation purposes.

As can be seen best in FIGS. 1 and 4, the tank 12 includes a recessed upper wall 32, and this upper wall is provided with a pressure relief valve 34 and a quick disconnect, one-way check valve 36, both of which communicate with the internal compartment 22. The quick disconnect valve 36 is employed to fill the compartment 22 with a desired beverage, and the pressure relief valve 34 is provided to prevent excessive pressure build-up within the tank. This arrangement for filling the tank automatically achieves a desired initial pressurization of the internal compartment 22 to assist in the dispensing of a beverage from said compartment when the tank is full.

It should be understood that the quick disconnect valve 36 is of a conventional construction and includes a normally closed valve which is automatically opened when it is connected to a mating valve section associated with the source of the beverage employed to fill the dispenser 10.

Figure 3:
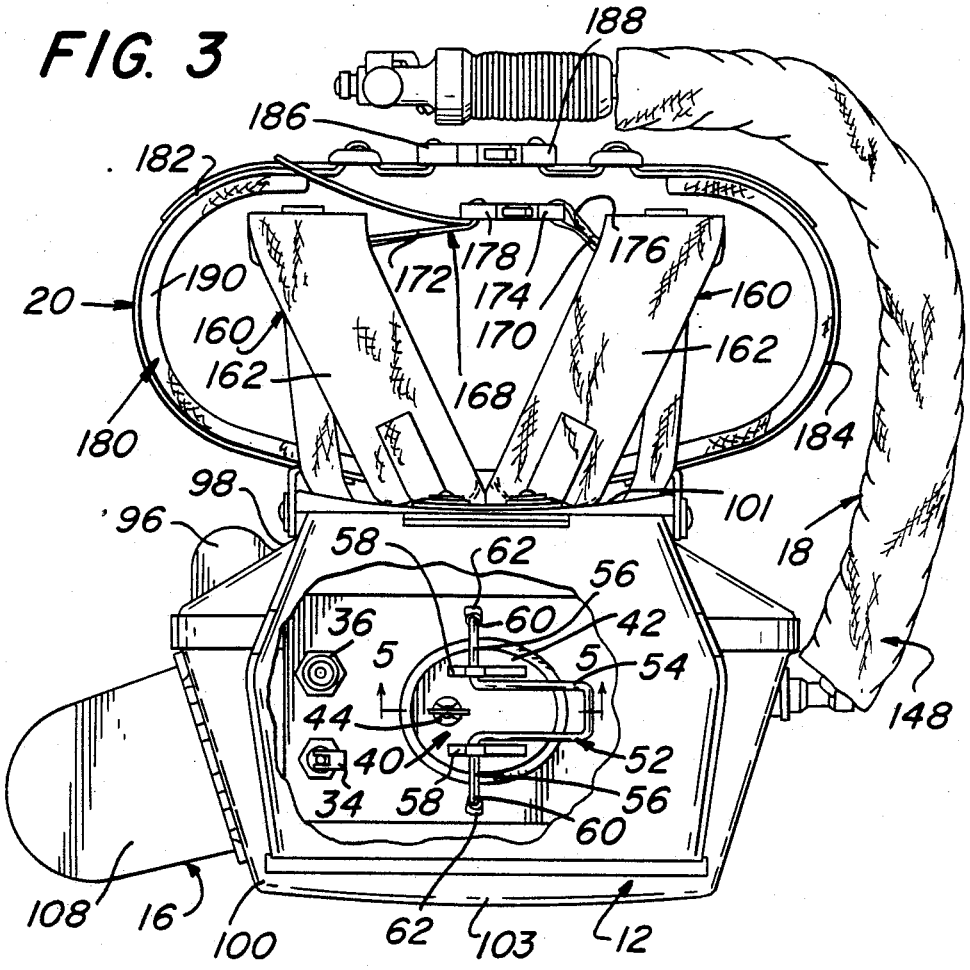
FIG. 3 is a plan view of the portable beverage dispenser of this invention with parts broken away to show certain details of construction.

As can be seen best in FIGS. 1, 3 and 5, a cap member 40 is provided to form a gas-tight seal for an access aperture 41 in the upper wall 32 of the tank. This access aperture preferably is employed to introduce a cleaning solution into the tank for the purpose of cleaning the tank at reasonable intervals, or when a change in the beverage to be dispensed (e.g., beer to coffee) is desired. Also, when a portion of the beverage is left in the tank at the end of a day, or the beverage either becomes too warm or too cold to be marketable, it easily can be disposed of through the enlarged access aperture 41.

During normal operation, when a beverage is being introduced through the one-way check valve 36, the cap 40 is retained in a gas-tight sealing arrangement about the access aperture 41. As a result of this arrangement the introduction of the beverage into the tank will automatically pressurize the interior compartment 22 thereof.

Still referring to FIGS. 1, 3 and 5, the cap 40 includes an upper wall 42 with a pressure relief valve 44 therein. This pressure relief valve is a safety feature, and includes a finger-engageable loop 45 which is manually pulled in an upward direction to relieve the internal pressure within the tank before the gas-tight seal about the access aperture 41 is broken.

The upper wall 42 of the cap terminates in a peripheral, annular sidewall 46 which extends into the tank 12, and an annular peripheral flange 48 at the bottom of the peripheral sidewall 46 overlies the peripheral inner tank wall 30 for cooperating with a sealing gasket 50 to provide the requisite fluid-tight seal.

Still referring to FIGS. 1, 3 and 5, the upward force applied to the cap 40 for establishing the fluid-tight seal is created through a locking bale 52. This bale includes a handle section 54 which is adapted to be gripped by the user for both opening and closing the cap. This handle section is a generally U-shaped member terminating in transversely directed members 56. These latter members extend through openings provided in brackets 58 that, in turn, are attached to the upper wall 42 of the cap. The transverse members 56 extend beyond the perimeter of the cap 50 and terminate in laterally directed legs 60. The free ends of these latter legs are provided with protective caps 62 for engaging the upper wall 32 of the tank 12 when the bale is in its locking position, as illustrated in FIGS. 1–3. Specifically, in this locking position the legs 60 of the bale 52 are pressed against the upper wall 32 of the tank to force the cap 40 in an upward direction, through the interaction of the transverse members 56 of the bale with the brackets 58.

To release the seal and open the cap the valve 44 is first actuated to relieve the internal pressure within the tank compartment 22. Thereafter the bale is rotated in a counterclockwise direction, as viewed in FIG. 5, through an angle of 90°. This causes the lower ends of the legs 60 to be rotated out of pressure engagement with the upper wall 32 of the tank, thereby releasing the compressive engagement of the flange 48 of the cap with the sealing gasket 50. However, since the legs 60 do extend beyond the perimeter of the cap 40 (and the periphery of the access aperture 41) they also function to prevent the cap 40 from falling into the interior compartment 22 of the tank when the seal between the cap and tank is released.

Referring specifically to FIGS. 1 and 4, a hard plastic cover 70 is attached to the upper end of the tank 12 through a hinged connection 72, to thereby permit the cover to be moved into a position overlying the recessed upper wall 32 of said tank. This cover functions to protect the various valves and fittings in the upper wall of the tank, and also provides a desirable aesthetic appearance for the overall beverage dispenser.

Referring to FIG. 2, the hand actuated pump 14 includes a gas (e.g., air) accumulation chamber or housing 82 in which a piston or plunger 84 is mounted for linear movement. As viewed in FIG. 2, downward movement of the plunger 84 directs air into the accumulation chamber or housing 82, and upward movement of the plunger forces the air out of the accumulating chamber 82 into a pump outlet conduit 86 connected to said chamber through a conventional coupling 88.

As can be seen best in FIGS. 2, 4 and 8, a tank inlet conduit 90 is connected at one end thereof to the pump outlet conduit 86 through a conventional one-way check valve 92, and at its opposite end with an entrance opening or passageway 94 which communicates with the interior tank compartment 22 adjacent the upper region thereof. Most preferably the beverage initially is filled to a level below the passageway 94, as indicated in phantom representation at 95 in FIG. 41, so that the pressurizing air introduced into the tank fills the upper region of the tank to create a pressurized region that acts downwardly on the beverage.

The one-way check valve 92 opens when the piston 84 is moved upwardly into the housing 82, as viewed in FIG. 2, to permit the air accumulated in said housing to be forced into the interior compartment 22 of the tank, but seals shut during the outward stroke of the plunger 84 to prevent the withdrawal of pressurizing air from the tank. It should be understood that the hand pump 14 preferably is of a conventional design, and is provided with an opening (not shown) in the housing 82 to permit air to be sucked therein when the piston 84 is moved in a downward direction, as viewed in FIG. 2.

As can be seen best in FIGS. 2 and 3, a pump housing 96 is molded as a unitary part of the outer plastic wall 26 of the tank 12, and overlies the check valve 92, the tank inlet conduit 90 and a part of the pump outlet conduit 86 to protect these parts against damage from improper handling and/or from inclement weather conditions.

As can be seen best in FIG. 2, the pump 14 is attached to a forward sidewall section 98 of the tank through a pair of mounting brackets 99. The forward sidewall section 98 is inclined in a rearward direction from a front wall 101 of the tank, and terminates in a rear sidewall section 100, which, in turn, inclines forwardly from a rear wall 103 of the tank. (FIG. 3).

As can be seen best in FIG. 2, the pump 14 is oriented in a generally vertical direction substantially parallel to the elongate dimension of the tank. In this orientation the pump 14 easily can be operated by reciprocating the plunger 84 in a linear direction substantiall parallel to the orientation of a vendor carrying the beverage dispenser 10. Thus, even when a vendor is in crowded quarters he or she can easily manipulate the plunder 84 of the pump without hitting, and possibly injuring people in the crowd.

Referring specifically to FIGS. 1–3 and 7, the cup dispenser 16 is mounted on the rear sidewall section 100 adjacent the forward sidewall section 98 on which the hand pump 14 is mounted. The cup dispenser includes an outer housing 102 which is generally U-shaped in transverse cross section, as can be seen best in FIG. 7. Specifically, the housing includes a pair of legs which terminate in transversely directed flanges 104. These flanges are secured to the rear sidewall section 100 by any suitable means, such as by welds, bolts or screws (not shown).

Referring specifically to FIG. 7, a retaining bracket 106 includes a rear wall 108 connected through a plurality of spaced-apart rivets (only one of which is shown at 110) to the rear sidewall section 100 of the tank 12. The bracket 106 further includes sidewalls 112 which converge toward each other in a direction from the rear wall 108 of said retaining bracket to marginal edges of said sidewalls. In addition, the sidewalls 112 converge slightly toward each other in a direction from an upper end of the bracket 106 to a lower end thereof. The rear wall 108 and sidewalls 112 define a channel 114 for receiving a cooperating mounting bracket associated with a cartridge which contains a stack of cups to be dispensed, as will now be described in greater detail.

Referring specifically to FIGS. 2 and 7, a cylindrical cartridge 116 is provided for receiving a nested stack of cups 118 therein. These cups are dispensed one at a time through an open bottom of the cartridge. The cartridge 116 is formed by attaching together overlapping longitudinal margins with longitudinally spaced apart rivets 120 (only one of which is shown in FIG. 7). These rivets 120 also secure the cartridge 116 to a rear wall 122 of a U-shaped mounting bracket 124.

The mounting bracket 124 includes opposed sidewalls 126 which diverge or flare outwardly from each other in a direction from the rear wall 122 to the marginal edges of said side-walls. In addition, the sidewalls 126 slightly converge in a direction from the upper end of the bracket 124 to a lower end thereof, to thereby provide a complimentary wedge-fit in the channel 114 defined by the sidewalls 112 and rear wall 110 of the retaining bracket 106. This wedge-fit is responsible for retaining the cylindrical cartridge 116, with the stack of cups therein, in proper position relative to the beverage dispensing tank 12, and also permits easy removal of the cartridge 116 from the tank (such as when filling the cartridge with cups is necessary), by merely applying a slight upward force to the cartridge, as viewed in FIG. 2. This upward force releases the wedge-fit, i.e., frictional engagement, between the sidewalls 126 of the mounting bracket 124 and the sidewalls 112 of the retaining bracket 126.

Referring specifically to FIGS. 1–3 it can be seen that the upper end of the outer housing 102 of the cup dispenser is provided with a pivotally attached cover member 108. This cover member closes the top of the housing, and thereby prevents foreign debris from entering the housing to contaminate cups retained therein.

Referring specifically to FIG. 2, the cylindrical cartridge 116 is of a conventional design, including inwardly directed retaining ribs 130 adjacent the lower end thereof for engaging the transversely extending lip 132 of the lowermost cup 118 in the stack, to thereby retain the entire stack of nested cups within the cartridge 116, in proper position for dispensing one-at-a-time. It should be noted that the stack of cups 118 is oriented in a generally vertical direction, substantially parallel to the orientation of the hand pump 14 and the elongate dimension of the beverage-containing insulated tank 12. This provides an extremely compact and functional arrangement of elements which easily can be manipulated by a vendor to permit the quick and effective vending of beverages from the tank 12 into cups.

Referring specifically to FIGS. 1, 3 and 6, the dispensing hose and nozzle assembly 18 includes a pivotal, quick disconnect fitting 140 of a conventional design secured into the lower end of the tank 12. The quick disconnect fitting 140 is connected to the lower end of the tank 12 in a rear sidewall section 142, opposite the rear sidewall section 100 on which the cup dispenser 16 is secured. A hose 144 of the assembly 18 includes a quick disconnect fitting 146 at a rear end thereof which is adapted to be connected to the fitting 140 secured within the sidewall of the tank 12. It should be understood that the quick disconnect fitting 140 includes a normally closed valve therein, which automatically is opened when it is connected to the mating fitting 146 at the rear end of the hose 144. The hose 144 is surrounded by a thermal insulating member 148, which perferably includes an internal inner neoprene rubber sleeve 149, a central foam layer 150 and an outer insulating fabric 152 (FIG. 6).

Referring to FIGS. 1 and 2, a conventional dispensing nozzle 154 is secured to the end of the hose 144 opposite the quick disconnect fitting 146, and includes a valve which normally is spring-biased into a closed position. A trigger 156 is provided, which, when manually actuated, forces the valve (not shown) of the nozzle 154 into an opened position, thereby resulting in the dispensing of a beverage from the tank 12, through the hose and nozzle assembly 18, and into a cup.

Referring specifically to FIGS. 1–3, the strap assembly 20 includes a pair of shoulder straps 160, each of which is provided by upper and lower strap sections 162, 164, respectively, adjustably interconnected through a buckle 166. Specifically, the buckle 166 of each of the shoulder straps 160 is fixedly secured to the upper strap section 162, such as by sewing. The lower strap section 164 is adjustably secured to the buckle 166 to permit the proper adjustment of the shoulder straps 160 about the shoulders and upper chest region of the vendor.

Still referring to FIGS. 1–3, an adjustable chest strap 168 is secured to the pair of shoulder straps 160 for aiding in the support of the dispenser 10 by a vendor, and for maintaining the shoulder straps 160 in proper position around the shoulders of the vendor. This chest strap includes opposed sections 170, 172, each of which is attached to an adjacent one of said pair of shoulder straps 16. A buckle section 174 is retained within a securing loop 176 of the section 170 for attachment to a cooperating buckle section 178 adjustably receiving the free end of the strap section 172. Most desirably the buckle sections 174 and 178 are of a conventional bayonnet-type construction, providing for the quick connect and disconnect thereof.

Still referring to FIGS. 1–3, the strap assembly 20 is completed by a waist strap 180 formed by a pair of waist strap sections 182, 184, each of which is adjustably connected to buckle sections 186 and 188. These latter buckle sections preferably are of the same bayonnet-type construction as the buckle sections 174 and 178 attached to the chest strap 168. Most preferably the inner surface of each of the waist sections 182 and 184 includes foam padding 190 to provide a more comfortable arrangement for the wearer, than if the padding were omitted.

From the above discussion it should be apparent that the portable beverage dispenser 10 of this invention provides an extremely convenient and compact arrangement, including all of the elements necessary for its effective use. In particular an air pump is provided, which is periodically used to pressurize the internal compartment 122 adjacent the upper end thereof, to be certain that a desired pressure level is maintained within the tank to assist in the proper dispensing of a beverage through the dispensing hose and nozzle assembly 18. Moreover, due to the location of the dispensing hose 18 adjacent the lower end of the compartment 22 of the tank 12, the dispensing of the beverage also is assisted by gravity. Thus, applicant has effectively combined gravity and pressure dispensing of a beverage in a portable beverage dispenser to provide an extremely reliable and efficient system. Moreover, applicant has positioned the air pump 14 in a location and orientation to permit its easy use without injuring other individuals, even when the pump is being actuated by the vendor when he or she is in a crowd.

In addition, a lower cup of a stack of cups easily can be dispensed by the vendor reaching slightly behind him (or her), and pulling the lower cup downwardly from the stack. Moreover, by retaining the stack of cups within a protective housing the cups are less likely to be damaged, than if they were carried loose or transported in some other fashion.

The dispenser of this invention also provides a desirable arrangement of quick disconnect fittings and pressure valves to permit the insulated tank 12 to be easily filled with a desired beverage, while preventing an undesired pressure buildup within the tank.

Moreover, the provision of a larger access aperture 41 in the tank 12 provides easy access into the internal compartment 22 to thereby permit the interior of the tank to be easily cleaned. Also, this access aperture 41 permits the rapid disposal of a beverage within the tank, when desired. For example, at the end of a day there may be a portion of a beverage still within the tank which cannot be saved and reused. This portion easily can be dispensed through the access aperture 41. In addition, when beverage sales are moving slowly, a change of temperature of the beverage within the tank may occur, even though the tank is insulated, thereby making the beverage undesirable for human consumption. Under these circumstances it may be desired to dispose of the remaining contents of the beverage, and refill the tank with a fresh supply. In such circumstances the undesired beverage easily can be disposed of by pouring it out of the access aperture 41.

The strap assembly 20 employed in this invention provides an extremely comfortable arrangement for a vendor, thereby permitting the vendor to wear the dispenser for the long periods of time often required at athletic, and other events at which beverages are dispensed.

Without further elaboration the foregoing will so fully illustrate my invention that others may, by applying current or future knowledge, adopt the same for use under various conditions of service.

What is claimed as the invention is:

1. A portable beverage dispenser for use by a vender, said dispenser including:

(a) an insulated tank having an internal compartment for receiving a beverage to be dispensed, said tank including a front wall adapted to be supported adjacent a vender's back, a rear wall spaced from said front wall and opposed sidewalls connecting said front wall to said rear wall;

(b) a discharge passage means through a sidewall of the insulated tank, said discharge passage means communicating with the internal compartment adjacent the lower end thereof;

(c) a fillport communicating with the internal compartment and through which a beverage to be dispensed can be introduced into said compartment;

(d) a pressurizing passage means through a wall of the insulated tank, said pressurizing passage means communicating with the internal compartment adjacent an upper end thereof;

(e) pump means attached to the sidewall of the tank opposite the sidewall through which the discharge passage means is included, said pump means including a fluid transmitting line communicating with the pressurizing passage means for introducing a pressurizing gas into the upper end of the internal compartment of the tank for pressurizing a beverage in said tank;

(f) a cup dispenser means attached to the same sidewall of the tank as the pump means, for retaining a stack of cups, whereby the vender utilizes either the pump means or the cup dispenser means with one hand; and (g) a nozzle means communicating with the discharge passage means for dispensing the beverage in the internal compartment of the tank, whereby the vender utilizes the nozzle means with the other hand to dispense the beverage.

2. The portable beverage dispenser of claim 1 wherein said tank has an elongate dimension between upper and lower walls thereof; said pump means including a gas accumulating chamber and a hand actuatable plunger therein, said plunger being movable in opposite linear directions substantially parallel to the elongate dimension of the tank for directing a gas into the accumulating chamber and for forcing said gas from the accumulating chamber into the internal compartment of the tank.

3. The portable beverage dispenser of claim 2 wherein said pump means is an air pump.

4. The portable beverage dispenser of claim 2 wherein said cup dispenser means retains said stack generally parallel to the elongate dimension of the tank.

5. The portable beverage dispenser of claim 4 further including a strap assembly for supporting the tank adjacent the back of a vendor.

6. The portable beverage dispenser of claim 2 further including a strap assembly for supporting the tank adjacent the back of a vendor.

7. The portable beverage dispenser of claim 1 including pressure relief valve means communicating with the internal compartment of the tank for preventing excess pressure build-up within said tank.

8. The portable beverage dispenser of claim 1 including an aperture through a wall of the tank communicating with the internal compartment for providing access to said internal compartment for cleaning said compartment and a cap means removably secured within said aperture for sealing said aperture.

9. The portable beverage dispenser of claim 8 further including a first pressure relief valve extending through a wall of the tank and communicating with the internal compartment thereof, and a second pressure relief valve in the cap means and communicating with the internal compartment of said tank.

10. The portable beverage dispenser of claim 1 wherein the sidewall to which the pump means and cup dispenser means are attached includes a front section and a rear section joined to each other, said front section also being joined to a marginal edge of the front wall and sloping rearwardly in a direction away from said front wall, said rear section also being joined to a marginal edge of said rear wall and sloping forwardly in a direction away from said rear wall, said pump means being attached to the front section and said cup dispenser means being attached to the rear section.

11. A portable beverage dispenser including an insulated tank having an internal compartment for receiving a beverage to be dispensed, said tank having a front wall adapted to be supported adjacent a vender's back, a rear wall spaced from said front wall, and opposed sidewalls connecting said front wall to said rear wall; each of said sidewalls having a front section and a rear section joined to each other, said front section also being joined to a marginal edge of the front wall and sloping rearwardly in a direction away from said front wall, said rear section also being joined to a marginal edge of said rear wall and sloping forwardly in a direction away from said rear wall; a discharge passage means through a wall of the insulated tank, said discharge passage means communicating with the internal compartment adjacent the lower end thereof; a fill port communicating with the internal compartment and through which a beverage to be dispensed can be introduced into said compartment; a pressurizing passage means through the wall of the insulated tank, said pressurizing passage means communicating with the internal compartment adjacent an upper end thereof; pump means attached to a front section of a sidewall, said pump means including a fluid transmitting line communicating with the pressurizing passage means for introducing a pressurizing gas into the upper end of the internal compartment of the tank for pressurizing a beverage in said tank; cup dispenser means attached to a rear section of a sidewall; and a nozzle means communicating with the discharge passage means for dispensing the beverage in the internal compartment of the tank.

12. The portable beverage dispenser of claim 11 wherein said pump means and said cup dispenser means are attached to front and rear sections of the same sidewall.

13. The portable beverage dispenser of claim 12 further including an aperture through a wall of the tank communicating with the internal compartment for providing access to said internal compartment for cleaning said compartment, a cap means removably secured within said aperture for sealing said aperture, a first pressure relief valve extending through a wall of the tank and communicating with the internal compartment thereof, and a second pressure relief valve in the cap means and communicating with the internal compartment of said tank.

14. The portable beverage dispenser of claim 11 further including an aperture through a wall of the tank communicating with the internal compartment for providing access to said internal compartment for cleaning said compartment, a cap means removably secured within said aperture for sealing said aperture, a first pressure relief valve extending through a wall of the tank and communicating with the internal compartment thereof, and a second pressure relief valve in the cap means and communicating with the internal compartment of said tank.

15. The portable beverage dispenser of claim 11 wherein said tank has an elongate dimension between upper and lower walls thereof, said cup dispenser means retaining said stack of cups in an orientation generally parallel to the elongate dimension of the tank.

16. The portable beverage dispenser of claim 15 further including an aperture through a wall of the tank communicating with the internal compartment for providing access to said internal compartment for cleaning said compartment, a cap means removably secured within said aperture for sealing said aperture, a first pressure relief valve extending through a wall of the tank and communicating with the internal compartment thereof, and a second pressure relief valve in the cap means and communicating with the internal compartment of said tank.

17. The portable beverage dispenser of claim 12 wherein said tank has an elongate dimension between upper and lower walls thereof, said cup dispenser means retaining said stack of cups in an orientation generally parallel to the elongate dimension of the tank.

18. The portable beverage dispenser of claim 17 further including an aperture through a wall of the tank communicating with the internal compartment for providing access to said internal compartment for cleaning said compartment, a cap means removably secured within said aperture for sealing said aperture, a first pressure relief valve extending through a wall of the tank and communicating with the internal compartment thereof, and a second pressure relief valve in the cap means and communicating with the internal compartment of said tank.

* * * * *